US011514870B2

(12) United States Patent
Xiao

(10) Patent No.: US 11,514,870 B2
(45) Date of Patent: Nov. 29, 2022

(54) TIMING CONTROLLER, DISPLAY PANEL AND RELATED DRIVING METHOD THEREOF

(71) Applicant: TCL CHINA STAR OPTOELECTRONICS TECHNOLOGY CO., LTD., Shenzhen (CN)

(72) Inventor: Guangxing Xiao, Shenzhen (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 191 days.

(21) Appl. No.: 16/771,167

(22) PCT Filed: May 19, 2020

(86) PCT No.: PCT/CN2020/091077
§ 371 (c)(1),
(2) Date: Jun. 9, 2020

(87) PCT Pub. No.: WO2021/223266
PCT Pub. Date: Nov. 11, 2021

(65) Prior Publication Data

US 2022/0114979 A1 Apr. 14, 2022

(30) Foreign Application Priority Data

May 7, 2020 (CN) ..... 202010379134.4

(51) Int. Cl.
*G09G 3/36* (2006.01)

(52) U.S. Cl.
CPC ..... *G09G 3/3611* (2013.01); *G09G 3/3607* (2013.01); *G09G 2300/0439* (2013.01); *G09G 2310/0291* (2013.01); *G09G 2310/08* (2013.01)

(58) Field of Classification Search
CPC ..... G09G 3/3611; G09G 3/3607; G09G 2300/0439; G09G 2310/0291; G09G 2310/08; G09G 2340/0457; G09G 2360/16
See application file for complete search history.

(56) References Cited

U.S. PATENT DOCUMENTS 7,151,549 B2 * 12/2006 Kudo ..... G09G 3/3696 345/89
7,956,821 B2 * 6/2011 Ikeno ..... G09G 3/3611 345/1.1
9,741,297 B2 * 8/2017 Uchiyama ..... G09G 3/3607
9,792,877 B2 * 10/2017 Park ..... G09G 3/2003
9,858,850 B2 * 1/2018 Lin ..... H04N 5/20
(Continued)

*Primary Examiner* — Michael J Jansen, II
(74) *Attorney, Agent, or Firm* — PV IP PC; Wei Te Chung; Ude Lu

(57) ABSTRACT

A timing controller, a display panel and a driving method are proposed. The display panel includes a display sub-pixel and a virtual sub-pixel. The display sub-pixel includes first sub-pixels, second sub-pixels and third sub-pixels. If the grayscale information of the two adjacent first sub-pixels are the same, then a driving signal of the virtual sub-pixel is the same as a driving signal of a third sub-pixel close to the virtual sub-pixel; otherwise, the driving signal of the virtual sub-pixel is the same as a driving signal of the third sub-pixels, which are outnumbered in the histogram.

3 Claims, 3 Drawing Sheets

(56) References Cited

U.S. PATENT DOCUMENTS

| | | | | |
|---|---|---|---|---|
| 9,984,623 | B2 * | 5/2018 | An | G09G 3/3233 |
| 10,276,129 | B2 * | 4/2019 | Lin | G09G 5/10 |
| 10,650,502 | B2 * | 5/2020 | Li | G09G 3/2003 |
| 10,950,202 | B2 * | 3/2021 | Choi | G09G 3/3426 |
| 10,971,065 | B2 * | 4/2021 | Hong | G09G 3/3233 |
| 11,018,208 | B2 * | 5/2021 | Sonoda | G09G 5/363 |
| 11,114,046 | B2 * | 9/2021 | Sun | G09G 3/3406 |
| 11,270,657 | B2 * | 3/2022 | Zhao | G09G 3/3426 |
| 2004/0196236 | A1 * | 10/2004 | Kudo | G09G 3/3696 345/89 |
| 2008/0088649 | A1 * | 4/2008 | Ikeno | G09G 3/3611 345/204 |
| 2008/0204481 | A1 * | 8/2008 | Mostinski | G09G 3/36 345/87 |
| 2011/0057961 | A1 * | 3/2011 | Tsuru | G09G 3/342 345/89 |
| 2014/0306983 | A1 * | 10/2014 | Park | G09G 3/2003 345/590 |
| 2016/0042680 | A1 * | 2/2016 | Lin | G09G 3/2007 345/694 |
| 2016/0189643 | A1 * | 6/2016 | Uchiyama | G09G 3/3426 345/89 |
| 2017/0092191 | A1 * | 3/2017 | An | G09G 3/3233 |
| 2017/0200430 | A1 * | 7/2017 | Lin | G09G 5/10 |
| 2018/0165802 | A1 * | 6/2018 | Li | G09G 5/026 |
| 2019/0305056 | A1 * | 10/2019 | Sonoda | H01L 27/3244 |
| 2020/0118525 | A1 * | 4/2020 | Choi | G09G 3/36 |
| 2021/0020116 | A1 * | 1/2021 | Sun | G09G 3/3426 |
| 2021/0065623 | A1 * | 3/2021 | Hong | G09G 3/3266 |
| 2021/0158766 | A1 * | 5/2021 | Zhao | G09G 3/3426 |

* cited by examiner

A

B

TIMING CONTROLLER, DISPLAY PANEL AND RELATED DRIVING METHOD THEREOF

CROSS REFERENCE

This application is a US national phase application based upon an International Application No. PCT/CN2020/091077, filed on May 19, 2020, which claims the priority of Chinese Patent Application No. 202010379134.4, entitled "TIMING CONTROLLER, DISPLAY PANEL AND RELATED DRIVING METHOD THEREOF", filed on May 7, 2020, the disclosure of which is incorporated herein by reference in its entirety.

FIELD OF THE INVENTION

The present invention relates to a display technique, and more particularly, to a timing controller, a display panel, and a related driving method thereof.

BACKGROUND

The LCD panel is widely used in all kinds of displays. It utilizes switches to modulate the luminance of the backlight module to display images. The LCD panel utilize thin film transistors (TFTs) to apply voltages corresponding to grayscale values on the pixels. Usually, the sources of the TFTs of a row of pixels are connected to a signal line (i.e. data line). The signal line is used to transfer the driving signal to the TFTs of the pixels. However, if the driving signal of the virtual pixel is not appropriate or has errors, the display panel may have a display problem, such as a bright line on the side.

Therefore, the conventional display has a display issue and needs to be improved.

SUMMARY

One objective of an embodiment of the present invention is to provide a timing controller, a display panel, and a related driving method to solve the above-mentioned display issue caused by the virtual sub-pixel.

According to an embodiment of the present invention, a timing controller is disclosed. The timing controller is configured to drive a display panel. The display panel comprises a display sub-pixel and a virtual sub-pixel. The display sub-pixel comprises rows of first sub-pixels, second sub-pixels and third sub-pixels arranged in order. The virtual sub-pixel is located at one side of the display sub-pixel and adjacent to a first row of the first sub-pixels. The timing controller comprises: a buffer unit, configured to temporarily store a grayscale information of a row of the display sub-pixel; a histogram generating unit, configured to generate a histogram of the first sub-pixels and the third sub-pixels of a row of the display sub-pixel according to the grayscale information temporarily stored in the buffer unit, wherein the histogram reflects numbers of the first sub-pixels and the third sub-pixels of a row of the display sub-pixel in different grayscale values; a grayscale comparing unit, configured to obtain the grayscale information of two adjacent first sub-pixels of the row of the display sub-pixel, which are close to the virtual sub-pixel and to compare the grayscale information of the two adjacent first sub-pixels; and a virtual sub-pixel driving unit, configured to drive the virtual sub-pixel; wherein if the grayscale information of the two adjacent first sub-pixels are the same, then a driving signal of the virtual sub-pixel is the same as a driving signal of a third sub-pixel close to the virtual sub-pixel; otherwise, the driving signal of the virtual sub-pixel is the same as a driving signal of the third sub-pixels, which are outnumbered in the histogram.

In the timing controller of the present disclosure, the histogram generating unit comprises: a first obtaining sub-unit, configured to obtain the grayscale information of the first sub-pixels and the third sub-pixels from the buffer unit; and a generating sub-unit, configured to generate the histogram according to the gray scale information of the first sub-pixels and the third sub-pixels.

In the timing controller of the present disclosure, the grayscale comparing unit comprises: a second obtaining sub-unit, configured to obtain the grayscale information of the two adjacent first sub-pixels of the row of the display sub-pixel, which are close to the virtual sub-pixel; and a comparing sub-unit, configured to compare the grayscale information of the two adjacent first sub-pixels.

In the timing controller of the present disclosure, the virtual sub-pixel driving unit comprises: a third obtaining sub-unit, configured to obtain the driving signal of the third sub-pixels, which are outnumbered in the histogram, calculated by the histogram generating unit in the timing controller; and a driving sub-unit, configured to utilize the driving signal obtained by the third obtaining sub-unit to drive the virtual sub-pixel.

In the timing controller of the present disclosure, if numbers of the third sub-pixels corresponding to two grayscale values are the same and the greatest in the histogram generating unit, then the third obtaining sub-unit randomly obtains a driving signal corresponding to one of the two grayscale values corresponding to the third sub-pixels.

According to an embodiment of the present invention, a driving method of utilizing the above-mentioned timing controller to drive a display panel is disclosed. The display panel comprises a display sub-pixel and a virtual sub-pixel. The display sub-pixel comprises rows of first sub-pixels, second sub-pixels and third sub-pixels arranged in order. The virtual sub-pixel is located at one side of the display sub-pixel and adjacent to a first row of the first sub-pixels. The driving method comprises: step S10: temporarily storing a grayscale information of a row of the display sub-pixel; step S20: generating a histogram of the first sub-pixels and the third sub-pixels of a row of the display sub-pixel according to the grayscale information, wherein the histogram reflects numbers of the first sub-pixels and the third sub-pixels of a row of the display sub-pixel in different grayscale values; step S30: obtaining the grayscale information of two adjacent first sub-pixels of the row of the display sub-pixel, which are close to the virtual sub-pixel and comparing the grayscale information of the two adjacent first sub-pixels; and step S40: if the grayscale information of the two adjacent first sub-pixels are the same, then a driving signal of the virtual sub-pixel is the same as a driving signal of a third sub-pixel close to the virtual sub-pixel; otherwise, the driving signal of the virtual sub-pixel is the same as a driving signal of the third sub-pixels, which are outnumbered in the histogram.

In the driving method of the present disclosure, the step S20 comprises: obtaining the grayscale information of the first sub-pixels and the third sub-pixels; and generating the histogram according to the gray scale information of the first sub-pixels and the third sub-pixels.

In the driving method of the present disclosure, the step 40 comprises: if the grayscale information of the two adjacent first sub-pixels are the same, then a driving signal of the virtual sub-pixel corresponding to the row is the same as a driving signal of a third sub-pixel close to the virtual sub-pixel; otherwise, the driving signal of the virtual sub-pixel corresponding to the row is the same as a driving signal of the third sub-pixels, which are outnumbered in the histogram.

In the driving method of the present disclosure, if numbers of the third sub-pixels corresponding to two grayscale values are the same and the greatest in the histogram generating unit, then randomly obtaining a driving signal corresponding to one of the two grayscale values corresponding to the third sub-pixels.

According to an embodiment of the present invention, a display device is disclosed. The display device comprises a display panel and the above-mentioned timing controller. The display panel comprises a source driver and a display region. The display region comprises a plurality of scan lines and a plurality of data lines. The source driver is electrically connected to the timing controller. The display panel comprises a display sub-pixel and a virtual sub-pixel. The display sub-pixel comprises rows of first sub-pixels, second sub-pixels and third sub-pixels arranged in order. The virtual sub-pixel is located at one side of the display sub-pixel and adjacent to a first row of the first sub-pixels.

The present invention provides a timing controller, a display panel and a related driving method. In an embodiment, the driving signal of the virtual sub-pixel of the display panel is set to be the same as the driving signal of the third sub-pixel (blue sub-pixel) close to the virtual sub-pixel. Or, the driving signal of the virtual sub-pixel is set to be the same as the driving signal of the third sub-pixels, which are outnumbered in the histogram. In this way, the display issue caused by the virtual sub-pixel could be solved.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF PREFERRED EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

As previously mentioned, the conventional display panel may have a display issue caused by the virtual sub-pixel. In the following disclosure, an embodiment will be illustrated to solve the issue.

Figure 1:
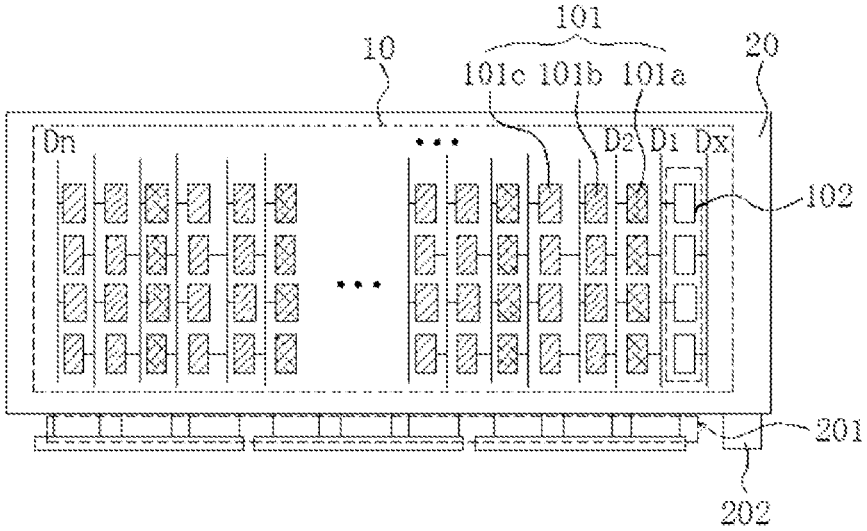
FIG. 1 is a diagram of a display panel according to an embodiment of the present invention.

Please refer to FIG. 1. FIG. 1 is a diagram of a display panel according to an embodiment of the present invention. The display panel comprises a display region 10 and a non-display region 20 surrounding the display region 10. The display panel comprises a plurality of data lines (Dx-Dn) and a plurality of scan lines in the display region 10. The display panel further comprises gate drivers (not shown), source drivers 201 and a timing controller 202. The timing controller 202 is electrically connected to the source drivers 201 and the gate drivers and is used to provide driving signals to the source drivers 201 and the gate drivers. The source drivers 201 are electrically connected to the data lines. The gate drivers are electrically connected to the gate lines.

The display panel further comprises a display sub-pixel 101 and a virtual sub-pixel 102. The display sub-pixel 101 comprises multiple rows of first sub-pixels 101*a*, second sub-pixels 101*b* and third sub-pixels 101*c*. The first sub-pixels 101*a* are red sub-pixels. The second sub-pixels 101*b* are green sub-pixels. The third sub-pixels 101*c* are blue sub-pixels. The virtual sub-pixel 102 is located at one side of the display sub-pixel 101 and adjacent to the first row of the first sub-pixels 101*a*.

In this embodiment, only one row of the virtual sub-pixel 102 is in the display panel. Please note, this is only an example, not a limitation of the present invention.

Figure 2:
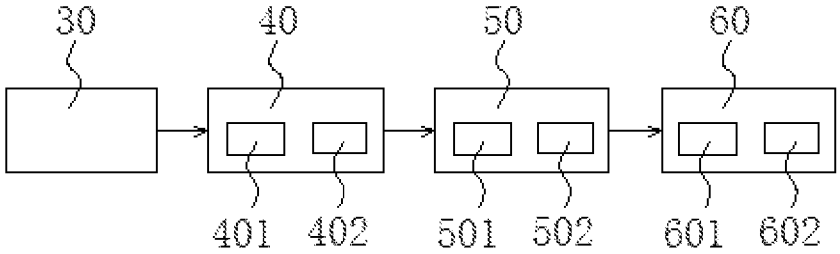
FIG. 2 is a diagram of a timing controller according to an embodiment of the present invention.

Please refer to FIG. 2 in conjunction with FIG. 1. FIG. 2 is a diagram of a timing controller according to an embodiment of the present invention. The timing controller is used to drive the display panel. The timing controller comprises a buffer unit 30, a histogram generating unit 40, a grayscale comparing unit 50, and a virtual sub-pixel driving unit 60.

The buffer unit 30 is used to temporarily store the grayscale information of a row of the display pixel 101. Here, the temporary storage means dynamically temporary storage. That is, the buffer unit 30 dynamically and temporarily stores the grayscale information of each row of the display sub-pixels 101 according to the scan sequence of the scan lines.

The histogram generating unit 40 is used to generate a histogram of the first sub-pixels 101*a* and the third sub-pixels 101*c* of a row of the display sub-pixel 101 according to the grayscale information temporarily stored in the buffer unit 30.

The histogram generating unit 40 comprises a first obtaining sub-unit 401 and a generating sub-unit 402. The first obtaining sub-unit 401 is used to obtain the grayscale information of the first sub-pixels 101*a* and the third sub-pixels 101*c* from the buffer unit 30. The generating sub-unit 402 is used to generate the histogram according to the gray scale information in the first obtaining sub-unit 401. In this embodiment, the histogram reflects numbers of the first sub-pixels 101*a* and the third sub-pixels 101*c* of a row of the display sub-pixel 101 in different grayscale values.

Figure 3:
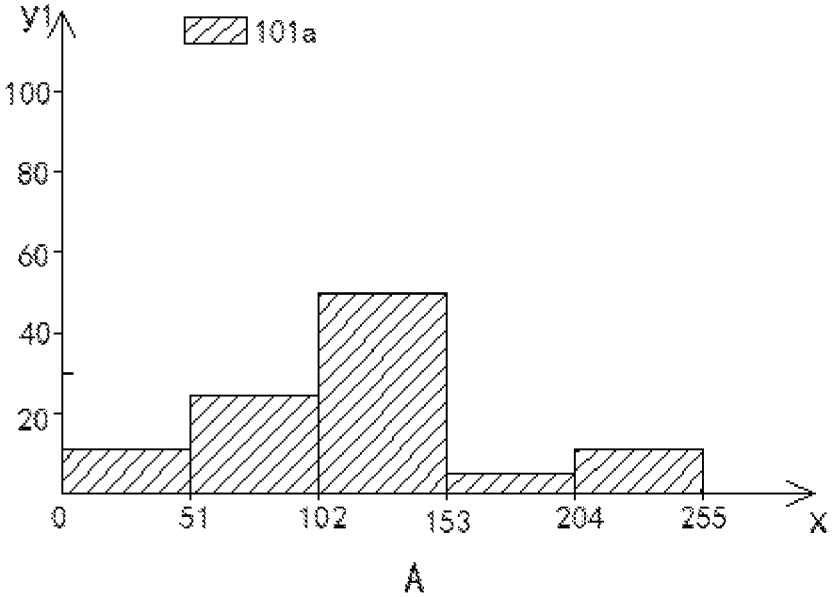
FIG. 3 is a diagram showing a histogram according to an embodiment of the present invention.
Figure 3:
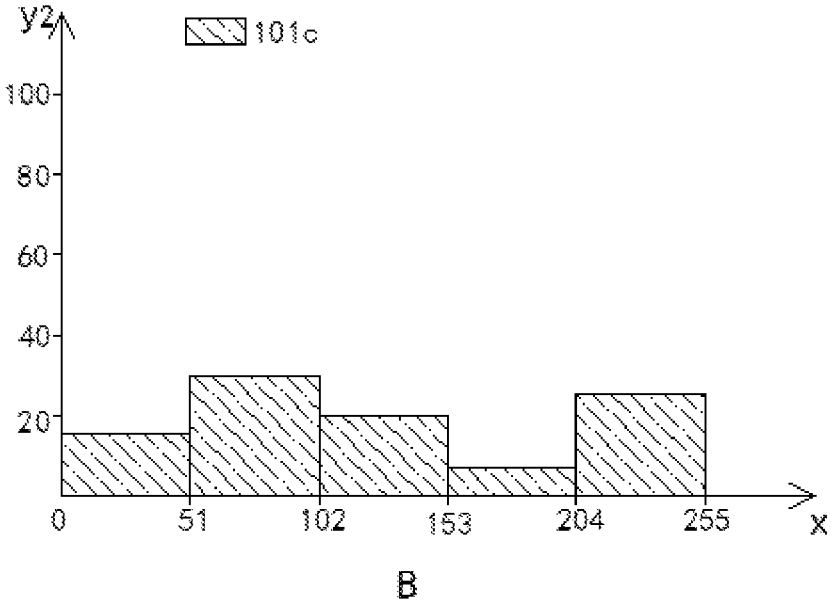

Please refer to FIG. 3. FIG. 3 is a diagram showing a histogram according to an embodiment of the present invention. Here, the x axis represents the grayscale value and the y axis represents the number of the sub-pixels. As shown in FIG. 3, the grayscale values 0-255 are divided into five regions for calculating the numbers of the first sub-pixels 101*a* and the third sub-pixels 101*c* of a row of the display sub-pixel 101 in different grayscale values. Pease note, the data in the histogram should be regarded as an example, not a limitation of the present invention. Furthermore, the division of the regions could be decided according to the actual implementation.

The grayscale comparing unit 50 is used to obtain the grayscale information of two adjacent first sub-pixels 101*a* of a row of the display sub-pixel 101, which are close to the virtual sub-pixel 102 and to compare the grayscale information of the two adjacent first sub-pixels 101*a*.

The grayscale comparing unit 50 comprises a second obtaining sub-unit 501 and a comparing sub-unit 502. The second obtaining sub-unit 501 is used to obtain the grayscale information of the two adjacent first sub-pixels 101*a*, which are close to the virtual sub-pixel, of the row of the display sub-pixel 101. The comparing sub-unit 502 is used to compare the grayscale information of the two adjacent first sub-pixels 101*a*.

The virtual sub-pixel driving unit 60 is used to generate a driving signal to drive the virtual sub-pixel 102. The driving signal is determined according to the comparison result of the grayscale comparing unit. If the grayscale information of the two adjacent first sub-pixels 101*a* are the same, then the driving signal of the virtual sub-pixel is the same as a driving signal of a third sub-pixel 101*c* close to the virtual sub-pixel 102. Otherwise, the driving signal of the virtual sub-pixel 102 is the same as a driving signal of the third sub-pixels 101*c*, which are outnumbered in the histogram calculated by the histogram generating unit 40.

The virtual sub-pixel driving unit 60 comprises a third obtaining sub-unit 601 and a driving sub-unit 602. The third obtaining sub-unit 601 is used to obtain the driving signal of the third sub-pixels 101*c*, which are outnumbered in the histogram, calculated by the histogram generating unit 40 in the timing controller. The driving sub-unit 602 is used to utilize the driving signal obtained by the third obtaining sub-unit 601 to drive the virtual sub-pixel 102.

In an embodiment, if the numbers of the third sub-pixels 101*c* corresponding to two grayscale values are the same and the greatest in the histogram generating unit 40, then the third obtaining sub-unit 601 randomly obtains a driving signal corresponding to one of the two grayscale values corresponding to the third sub-pixels 101*c*.

In an embodiment, the driving signal of the virtual sub-pixel of the display panel is set to be the same as the driving signal of the third sub-pixel (blue sub-pixel) close to the virtual sub-pixel. Or, the driving signal of the virtual sub-pixel is set to be the same as the driving signal of the third sub-pixels, which are outnumbered in the histogram. In this way, the display issue caused by the rightmost or the leftmost virtual sub-pixel could be solved.

Figure 4:
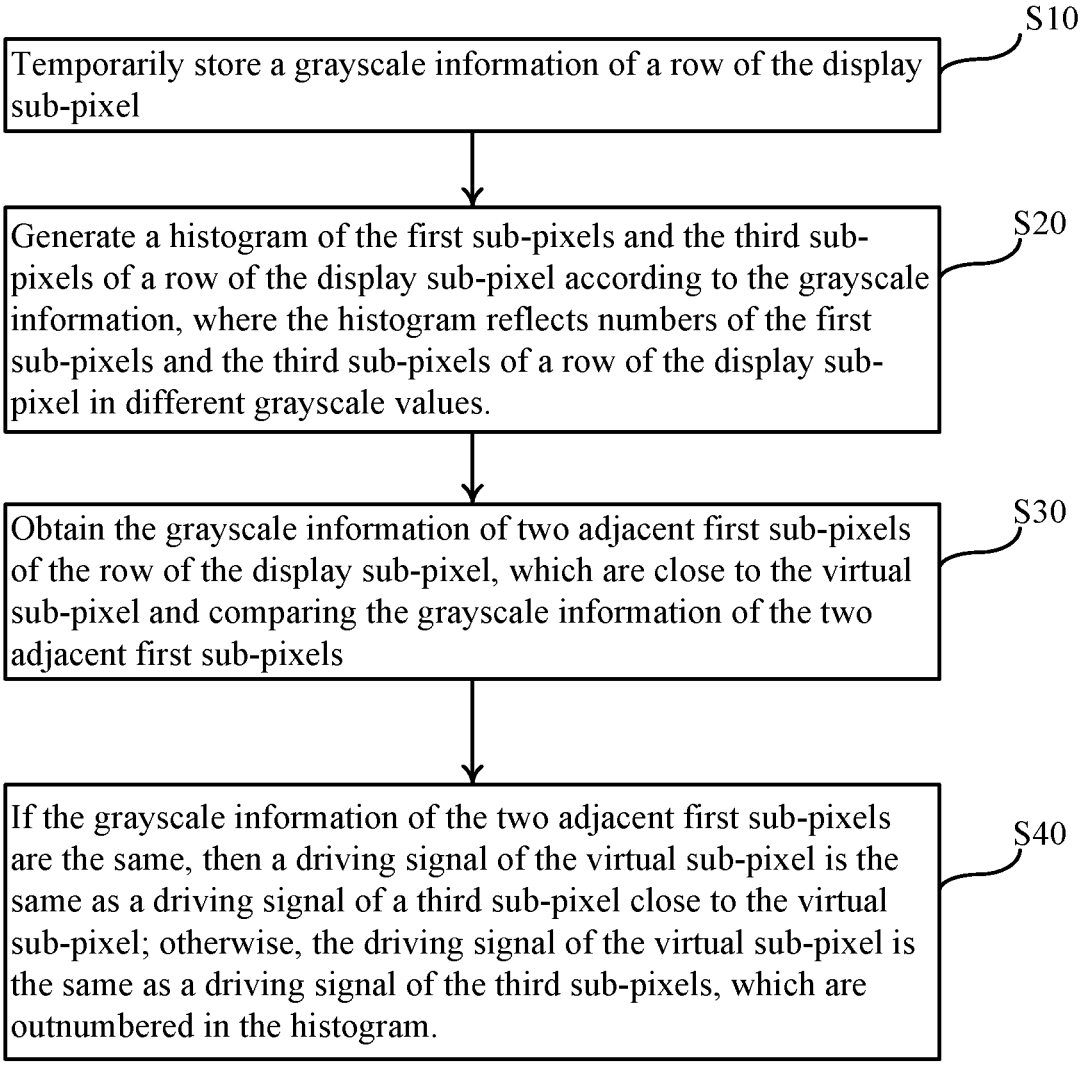
FIG. 4 is a flow chart of a driving method of a display panel according to an embodiment of the present invention.

In addition, a driving method for driving the above-mentioned display panel is disclosed. Please refer to FIGS. 1-4. FIG. 4 is a flow chart of a driving method of a display panel according to an embodiment of the present invention. The driving method comprises:

Step S10: temporarily storing a grayscale information of a row of the display sub-pixel.

Taking the first row of the sub-pixels in FIG. 1 as an example. When the scan line scans the first row of sub-pixels, the buffer unit 30 temporarily stores the grayscale information of the first row of the display sub-pixel 101.

Step S20: generating a histogram of the first sub-pixels and the third sub-pixels of a row of the display sub-pixel according to the grayscale information, wherein the histogram reflects numbers of the first sub-pixels and the third sub-pixels of a row of the display sub-pixel in different grayscale values.

The first obtaining sub-unit 401 obtains the grayscale information of the first sub-pixels 101*a* and the third sub-pixels 101*c* from the buffer unit 30. The generating sub-unit 402 generates the histogram of the first sub-pixels 101*a* and the third sub-pixels 101*c* according to the gray scale information in the first obtaining sub-unit 401. In this embodiment, the histogram reflects numbers of the first sub-pixels 101*a* and the third sub-pixels 101*c* of a row of the display sub-pixel 101 in different grayscale values.

Step S30: obtaining the grayscale information of two adjacent first sub-pixels of the row of the display sub-pixel, which are close to the virtual sub-pixel and comparing the grayscale information of the two adjacent first sub-pixels.

The second obtaining sub-unit 501 obtains the grayscale information of the two adjacent first sub-pixels 101*a*, which are close to the virtual sub-pixel 102, of the row of the display sub-pixel 101. That is, the two adjacent first sub-pixels 101*a* are the sub-pixels of the first row and the fourth row which are close to the virtual sub-pixel 102. The comparing sub-unit 502 compares the grayscale information of the two adjacent first sub-pixels 101*a*.

Step S40: if the grayscale information of the two adjacent first sub-pixels are the same, then a driving signal of the virtual sub-pixel is the same as a driving signal of a third sub-pixel close to the virtual sub-pixel; otherwise, the driving signal of the virtual sub-pixel is the same as a driving signal of the third sub-pixels, which are outnumbered in the histogram.

Because the first sub-pixel 101*a* and the third sub-pixel 101*c* are connected to a source driver 201 (one channel), the grayscale value of the third sub-pixel 101*c* influences the charging time of the first sub-pixel 101*a*. Through the histogram, the relevance between them could be identified. That is, if the grayscale value of the first sub-pixel 101*a* is similar to the grayscale value of an adjacent first sub-pixel 101*a*, then the similarity between them is the highest.

In the step S40, if the grayscale information of the two adjacent first sub-pixels are different, the driving signal of the third sub-pixels, which are outnumbered in the histogram is obtained. The timing controller 202 drives the virtual sub-pixel 102 according to the driving signal of the third sub-pixels, which are outnumbered in the histogram.

The third obtaining sub-unit 601 obtains the driving signal of the third sub-pixels 101*c*, which are outnumbered in the histogram, calculated by the histogram generating unit 40 in the timing controller. The driving sub-unit 602 utilizes the driving signal obtained by the third obtaining sub-unit 601 to drive the virtual sub-pixel 102.

In the step S40, if the grayscale information of the two adjacent first sub-pixels are the same, then the driving signal of the virtual sub-pixel 102 corresponding to the row is the same as the driving signal of the third sub-pixel 101*c* close to the virtual sub-pixel 102. Otherwise, the driving signal of the virtual sub-pixel 102 corresponding to the row is the same as the driving signal of the third sub-pixels 101*c*, which are outnumbered in the histogram.

In an embodiment, if the numbers of the third sub-pixels 101*c* corresponding to two grayscale values are the same and the greatest in the histogram, a driving signal corresponding to one of the two grayscale values corresponding to the third sub-pixels 101*c* is randomly obtained.

In an embodiment of the present invention, a display device is disclosed. The display device comprises a display panel and the above-mentioned timing controller. Please refer to FIG. 1 and FIG. 2. The display panel comprises a display region 10. The display panel comprises a plurality of data lines (Dx-Dn) and a plurality of scan lines in the display region 10. The display panel further comprises source drivers 201 and the above-mentioned timing controller 202.

The display panel further comprises a display sub-pixel 101 and a virtual sub-pixel 102. The display sub-pixel 101 comprises multiple rows of first sub-pixels 101*a*, second sub-pixels 101*b* and third sub-pixels 101*c*. The virtual sub-pixel 102 is located at one side of the display sub-pixel 101 and adjacent to the first row of the first sub-pixels 101*a*.

In an embodiment, the driving signal of the virtual sub-pixel of the display panel is set to be the same as the driving signal of the third sub-pixel (blue sub-pixel) close to the virtual sub-pixel. Or, the driving signal of the virtual sub-pixel is set to be the same as the driving signal of the third sub-pixels, which are outnumbered in the histogram. In this way, the display issue caused by the rightmost or the leftmost virtual sub-pixel could be solved.

Above are embodiments of the present invention, which does not limit the scope of the present invention. Any modifications, equivalent replacements or improvements within the spirit and principles of the embodiment described above should be covered by the protected scope of the invention.

What is claimed is:

1. A timing controller, configured to drive a display panel, the display panel comprising a plurality of display sub-pixels and a virtual sub-pixel arranged in a row, each of the display sub-pixels comprises a first sub-pixel, a second sub-pixel, and a third sub-pixel arranged in order, the virtual sub-pixel is located at outermost side of the row, the timing controller performing operations comprising:

temporarily storing a grayscale information of the plurality of display sub-pixels in the row;

generating a histogram of the first sub-pixels and the third sub-pixels of the plurality of display sub-pixels in the row according to the grayscale information, wherein the histogram reflects numbers of the first sub-pixels and the third sub-pixels of the plurality of display sub-pixels in the row in different grayscale values;

comparing the grayscale information of two first sub-pixels of a first display sub-pixel and a second display sub-pixel in the row, where the virtual sub-pixel, the first display sub-pixel, and the second display sub-pixel are arranged in order the virtual sub-pixel;

if the grayscale information of the two first sub-pixels of the first display sub-pixel and the second display sub-pixel in the row are the same, driving the virtual sub-pixel according to a driving signal the same as a driving signal of a third sub-pixel of the first display sub-pixel; and if the grayscale information of the two first sub-pixels of the first display sub-pixel and the second display sub-pixel in the row are different, driving the virtual sub-pixel according to a driving signal the same as a driving signal of a third sub-pixel of the first display sub-pixel which are outnumbered in the histogram.

2. A driving method of utilizing a timing controller to drive a display panel, the display panel comprising a plurality of display sub-pixels and a virtual sub-pixel arranged in a row, each of the display sub-pixels comprises a first sub-pixel, a second sub-pixel, and a third sub-pixel arranged in order, the virtual sub-pixel is located at outermost side of the row, the driving method comprising:

temporarily storing a grayscale information of the plurality of display sub-pixels in the row;

generating a histogram of the first sub-pixels and the third sub-pixels of the plurality of display sub-pixels in the row according to the grayscale information, wherein the histogram reflects numbers of the first sub-pixels and the third sub-pixels of the plurality of display sub-pixels in the row in different grayscale values;

comparing the grayscale information of two first sub-pixels of a first display sub-pixel and a second display sub-pixel in the row, where the virtual sub-pixel, the first display sub-pixel, and the second display sub-pixel are arranged in order the virtual sub-pixel;

if the grayscale information of the two first sub-pixels of the first display sub-pixel and the second display sub-pixel in the row are the same, driving the virtual sub-pixel according to a driving signal the same as a driving signal of a third sub-pixel of the first display sub-pixel; and if the grayscale information of the two first sub-pixels of the first display sub-pixel and the second display sub-pixel in the row are different, driving the virtual sub-pixel according to a driving signal the same as a driving signal of a third sub-pixel of the first display sub-pixel which are outnumbered in the histogram.

3. A display device, comprising:

a timing controller; and a display panel, comprising:

a source driver, electrically connected to the timing controller; and a plurality of scan lines and a plurality of data lines corresponding to a display area;

a plurality of display sub-pixels, connected to the plurality of data lines, wherein each of the display sub-pixel comprises a first sub-pixel, a second sub-pixel, and a third sub-pixel arranged in order; and a virtual sub-pixel located at outermost side of the row, wherein the timing controller performs operations comprising:

temporarily storing a grayscale information of the plurality of display sub-pixels in the row;

generating a histogram of the first sub-pixels and the third sub-pixels of the plurality of display sub-pixels in the row according to the grayscale information, wherein the histogram reflects numbers of the first sub-pixels and the third sub-pixels of the plurality of display sub-pixels in the row in different grayscale values;

comparing the grayscale information of two first sub-pixels of a first display sub-pixel and a second display sub-pixel in the row, where the virtual sub-pixel, the first display sub-pixel, and the second display sub-pixel are arranged in order the virtual sub-pixel;

if the grayscale information of the two first sub-pixels of the first display sub-pixel and the second display sub-pixel in the row are the same, driving the virtual sub-pixel according to a driving signal the same as a driving signal of a third sub-pixel of the first display sub-pixel; and if the grayscale information of the two first sub-pixels of the first display sub-pixel and the second display sub-pixel in the row are different, driving the virtual sub-pixel according to a driving signal the same as a driving signal of a third sub-pixel of the first display sub-pixel which are outnumbered in the histogram.

* * * * *